US006874513B2

(12) United States Patent
Yamagata et al.

(10) Patent No.: US 6,874,513 B2
(45) Date of Patent: Apr. 5, 2005

(54) HIGH PRESSURE PROCESSING APPARATUS

(75) Inventors: Masahiro Yamagata, Takasago (JP); Hisanori Oshiba, Takasago (JP); Yoshihiko Sakashita, Takasago (JP); Yoichi Inoue, Takasago (JP); Yusuke Muraoka, Kyoto (JP); Kimitsugu Saito, Kyoto (JP); Ikuo Mizobata, Kyoto (JP); Ryuji Kitakado, Kyoto (JP)

(73) Assignees: Kabushiki Kaisha Kobe Seiko Sho, Kobe (JP); Dainippon Screen Mfg. Co., Ltd., Kyoto (JP)

( * ) Notice: Subject to any disclaimer, the term of this patent is extended or adjusted under 35 U.S.C. 154(b) by 375 days.

(21) Appl. No.: 10/123,252

(22) Filed: Apr. 17, 2002

(65) Prior Publication Data

US 2002/0148492 A1 Oct. 17, 2002

(30) Foreign Application Priority Data

Apr. 17, 2001 (JP) ..... 2001-117693

(51) Int. Cl.[7] ..... B08B 3/02

(52) U.S. Cl. ..... 134/95.3; 134/103.1; 134/108; 134/902

(58) Field of Search ..... 134/95.3, 103.1, 134/200, 107, 108, 902; 68/18 R, 18 C

(56) References Cited

U.S. PATENT DOCUMENTS 5,344,493 A * 9/1994 Jackson ..... 134/1
5,377,705 A * 1/1995 Smith et al. ..... 134/95.3
5,772,783 A * 6/1998 Stucker ..... 134/12
6,085,762 A * 7/2000 Barton ..... 134/25.4
6,088,863 A * 7/2000 McClain et al. ..... 8/159
6,248,136 B1 * 6/2001 McClain et al. ..... 8/142
6,334,340 B1 * 1/2002 Kegler et al. ..... 68/18 R
6,355,072 B1 * 3/2002 Racette et al. ..... 8/142
6,360,392 B1 * 3/2002 Malchow ..... 8/159
6,397,421 B1 * 6/2002 Brainard et al. ..... 8/158
6,446,644 B1 * 9/2002 Dolechek ..... 134/57 R
6,453,924 B1 * 9/2002 Wang et al. ..... 137/1
6,477,440 B1 * 11/2002 Davis ..... 700/123
6,558,475 B1 * 5/2003 Jun et al. ..... 134/21
6,558,622 B1 * 5/2003 Malchesky ..... 422/28
6,602,349 B2 * 8/2003 Chandra et al. ..... 134/19
6,612,317 B2 * 9/2003 Costantini et al. ..... 134/58 R
2003/0205510 A1 * 11/2003 Jackson ..... 210/86
2004/0025908 A1 * 2/2004 Douglas ..... 134/56 R

FOREIGN PATENT DOCUMENTS

JP 5-226311 9/1993

* cited by examiner

*Primary Examiner*—Frankie L. Stinson
(74) *Attorney, Agent, or Firm*—Oblon, Spivak, McClelland, Maier & Neustadt, P.C.

(57) ABSTRACT

A high-pressure processing apparatus for removing unnecessary matters on objects to be processed by bringing a high-pressure fluid and a chemical liquid other than the high-pressure fluid into contact with the objects to be processed in a pressurized state is provided with a plurality of high-pressure processing chambers, a common high-pressure fluid supply unit for supplying the high-pressure fluid to each one of the high-pressure processing chambers, a common chemical liquid supply unit for supplying the chemical liquid to the each high-pressure processing chambers, and a separating unit for separating gaseous components from a mixture of the high-pressure fluid and the chemical liquid discharged from the high-pressure processing chambers after the objects are processed.

Thus, a high-pressure processing apparatus which has such a compact construction as to be partly installable in a clean room and can stably perform a high-pressure processing can be provided.

14 Claims, 3 Drawing Sheets

HIGH PRESSURE PROCESSING APPARATUS

BACKGROUND OF THE INVENTION AND RELATED ART STATEMENT

1. Field of the Invention

The present invention relates to a high-pressure processing apparatus optimally used, for example, to efficiently clean an object to be processed having a fine unevenness on the outer surface (microstructured surface) such as a semiconductor wafer or a semiconductor substrate and, for example, to a high-pressure processing apparatus installed in a clean room and used to peel off and remove contaminants such as resists adhered to the outer surface of a wafer during a semiconductor production process. The present invention also relates to a high-pressure processing apparatus used for drying for removing moisture attached to the outer surface of a wafer and for development for removing unnecessary portions present on the outer surface of the wafer.

2. Description of the Related Art

In the case of forming a pattern using a resist during a semiconductor production process, a cleaning step is essential to remove unnecessary and contaminant matters such as the resist which becomes unnecessary after the formation of the pattern and an etching polymer which is created during etching and remains on the wafer from the wafer.

Since the semiconductor production process is performed in a clean room, it is desirable to also perform the cleaning step in the clean room. However, it is costly not only to build the clean room, but also to maintain it. Thus, a cleaning apparatus is required to have a small installation area and excellent function and cleaning ability.

Conventionally, a wet cleaning unit according to which a semiconductor wafer or the like is immersed in a peeling liquid (cleaning liquid) and then rinsed with an alcohol or super pure water has been adopted as a semiconductor wafer cleaning method. Organic and inorganic compounds have been used as a peeling liquid. However, there have been problems that the peeling liquid cannot enter recessed portions of the fine pattern due to high surface tension and viscosity of the liquid, projected portions of the pattern are destroyed due to a capillary force created on a gas-liquid interface when the peeling liquid or a rinsing liquid are dried and a cubic expansion resulting from heating at the time of drying. Thus, the use of a fluid having a low viscosity such as supercritical carbon dioxide as the peeling liquid or the rinsing liquid has been recently studied.

For example, Japanese Unexamined Patent Publication No. 5(HEI)-226311 discloses a cleaning apparatus installable in a clean room and used to dissolve and remove contaminants such as moisture, fats and esters on the outer surface of a semiconductor wafer in a supercritical fluid. If carbon dioxide which easily evaporates at an atmospheric pressure, is excellent in safety, and inexpensive is used as a high-pressure or supercritical fluid, a carbon dioxide fluid can easily remove the moisture and fats on the outer surface of the wafer as disclosed in the above publication since having about as large a dissolving power as hexane, but a power thereof to dissolve polymer contaminants such as resists and etching polymers is insufficient. Thus, it is difficult to peel and remove these contaminants only by the carbon dioxide. Therefore, it is desirable to peel and remove polymer contaminants by adding a chemical liquid to the carbon dioxide.

On the other hand, for a more efficient cleaning step, a plurality of high-pressure processing chambers capable of performing cleaning while holding a high-pressure fluid should be provided and objects to be processed should be cleaned in the respective chambers. However, there is no consideration in the above publication No. 5-226311 about an apparatus which can precisely supply a high-pressure fluid and a chemical liquid to the respective chambers and is so designed to have a small installation area.

Further, in the case that a plurality of chambers are provided and different steps are performed in the respective chambers, supplied amounts of the high-pressure fluid differ according to a time table. Thus, a difficulty to properly maintain the pressure in the entire apparatus and a difficulty to stably perform the individual operations have been found out as problems.

In view of the problems residing in the prior art, an object of the present invention is to provide a high-pressure processing apparatus which has such a compact construction as to have part thereof installed in a clean room and can stably perform a high-pressure processing.

SUMMARY OF THE INVENTION

The invention is directed to a high-pressure processing apparatus for removing unnecessary matters on objects to be processed by bringing a high-pressure fluid and a chemical liquid other than the high-pressure fluid into contact with the objects to be processed in a pressurized state, comprising a plurality of high-pressure processing chambers; a common high-pressure fluid supply unit for supplying the high-pressure fluid to each one of the high-pressure processing chambers; a common chemical liquid supply unit for supplying the chemical liquid to the each high-pressure processing chambers; and a separating unit for separating gaseous components from a mixture of the high-pressure fluid and the chemical liquid discharged from the high-pressure processing chambers after the objects are processed.

These and other subjects, features and advantages of the present invention will become more apparent upon a reading of the following detailed description and accompanying drawings.

DETAILED DESCRIPTION OF THE PREFERRED EMBODIMENTS OF THE PRESENT INVENTION

Figure 1:
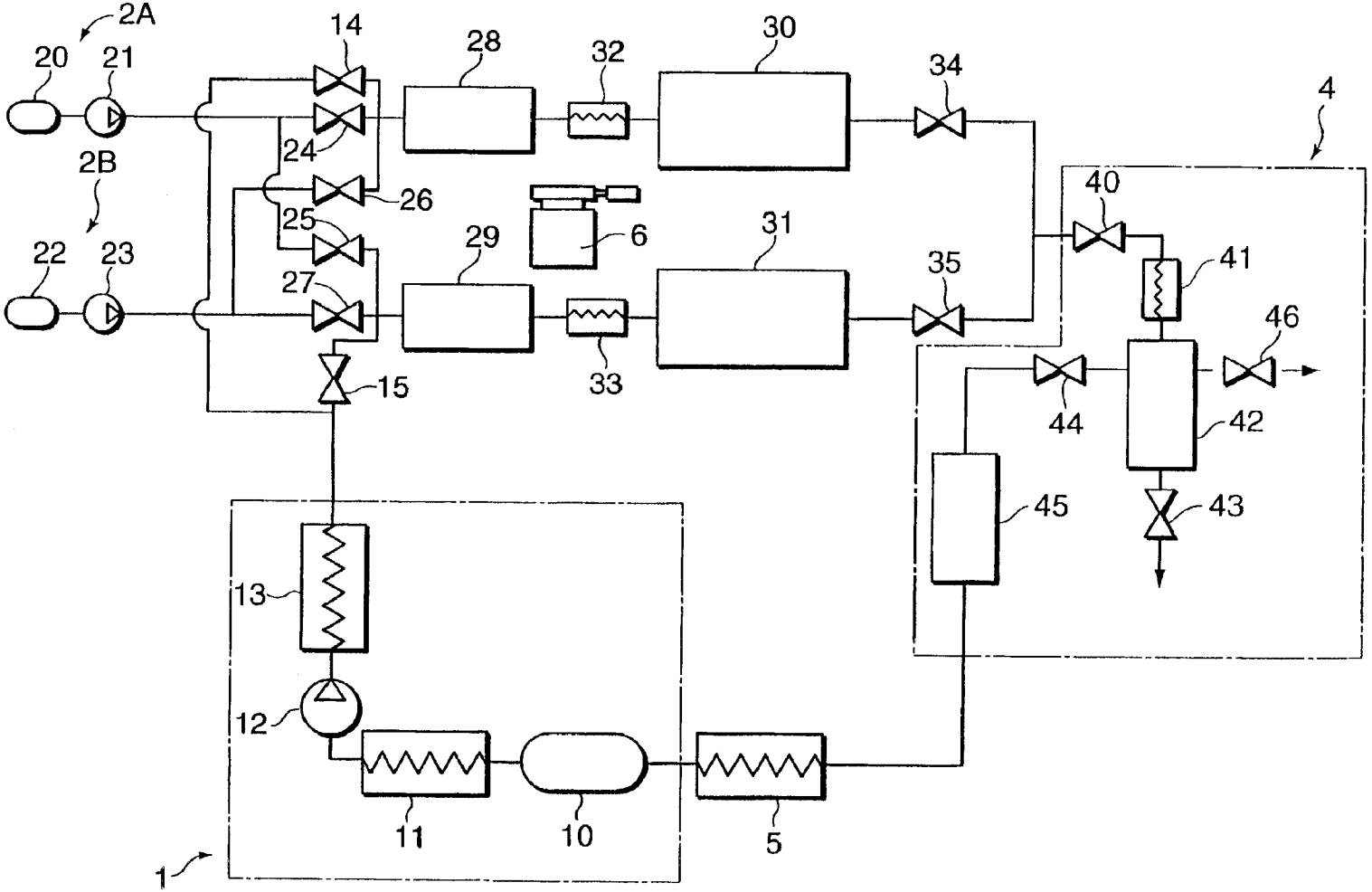
FIG. 1 is a diagram showing one embodiment of a high-pressure processing apparatus according to the invention.

As an operation performed in a high-pressure processing apparatus according to the present invention, a cleaning operation for peeling and removing contaminants from an object to be processed having contaminants adhered thereto such as a semiconductor wafer having a resist adhered thereto is given as a representative example. The objects to be processed are not restricted to semiconductor wafers, and may include those in which layers of different kinds of materials are continuously or discontinuously formed on various base members such as metals, plastics and ceramics. Not only the cleaning operation, but also all operations (e.g.

drying, development) for removing unnecessary matters from the object to be processed using a high-pressure fluid and a chemical liquid other than the high-pressure fluid are the operations performed by the high-pressure processing apparatus of the present invention.

According to an aspect of the invention, a high-pressure processing apparatus for removing unnecessary matters on objects to be processed by bringing a high-pressure fluid and a chemical liquid other than the high-pressure fluid into contact with the objects to be processed in a pressurized state, comprises a plurality of high-pressure processing chambers; a common high-pressure fluid supply unit for supplying the high-pressure fluid to each one of the high-pressure processing chambers; a common chemical liquid supply unit for supplying the chemical liquid to the each high-pressure processing chambers; and a separating unit for separating gaseous components from a mixture of the high-pressure fluid and the chemical liquid discharged from the high-pressure processing chambers after the objects are processed.

The removal processing can be efficiently performed since the plurality of high-pressure processing chambers are provided, and the high-pressure processing apparatus is allowed to have a compact construction since the high-pressure fluid supply unit and the chemical liquid supply unit are commonly used for the respective chambers.

Preferably, at least the plurality of high-pressure processing chambers are installed in a clean room, and at least the high-pressure fluid supply unit is installed outside the clean room. With such a construction, an area taken up by the processing apparatus in the clean room can be smaller.

The plurality of high-pressure processing chambers may be installed in a clean room, and the high-pressure fluid supply unit, the chemical liquid supply unit and the separating unit may be installed outside the clean room. Such a construction is further preferable since the area taken up by the processing apparatus in the clean room can be even smaller.

Preferably, the separating unit and the high-pressure fluid supply unit are connected, a liquefying unit is provided between the separating unit and the high-pressure fluid supply unit, and the liquefying unit is installed outside the clean room. With such a construction, the high-pressure fluid can be used in a recirculated manner since the gaseous components separated by the separating unit can be liquefied. Further, the area taken up by the processing apparatus in the clean room is not increased since the liquefying unit is installed outside the clean room.

Preferably, chemical liquid supply control units for controlling a supplied amount of the chemical liquid are provided for the respective high-pressure processing chambers between the chemical liquid supply unit and the respective high-pressure processing chambers; mixing units for mixing the high-pressure fluid and the chemical liquid are provided between the respective chemical liquid supply control units and the respective high-pressure processing chambers; and the chemical liquid supply control units and the mixing units are installed in the clean room. Different high-pressure processings can be performed in the respective high-pressure processing chambers by providing the chemical liquid supply control units for the respective high-pressure processing chambers, with the result that an efficiency of the entire apparatus in removing the unnecessary matters can be improved. There is an additional effect of preventing the high-pressure fluid from entering the chemical liquid supply unit. Further, the removal efficiency can be improved since the high-pressure fluid and the chemical liquid are introduced to the high-pressure processing chambers in a satisfactorily mixed state.

Preferably, each of the mixing units mix the high-pressure fluid and the chemical liquid by controlling flowing directions of the high-pressure fluid and the chemical liquid to join them. If the flowing directions of the high-pressure fluid and the chemical liquid are controlled by dividing or displacing the flows thereof in a pipe, the high-pressure fluid and the chemical liquid flow from an upstream side to a downstream side while being vertically displaced in the pipe, with the result that they can be sufficiently mixed.

Preferably, a heating unit is provided for each of the high-pressure processing chambers and installed in the clean room. With such a construction, minute conditions can be set for the removal processing since the high-pressure fluid and the chemical liquid can be heated to temperatures suited to the high-pressure processings performed in the high-pressure processing chambers and the temperature of the high-pressure fluid and the chemical liquid can be changed for the respective high-pressure processing chambers.

Preferably, the separating unit is provided for each of the high-pressure processing chambers. With such a construction, conditions on the separation of the gaseous components from the high-pressure fluid can be suitably changed according to the removal conditions of the high-pressure processing chambers and the like.

Preferably, there is further provided a returning unit for returning the fluid liquefied by the liquefying unit to the separating unit as a high-pressure fluid containing no unnecessary matter. With such a construction, in the case that distillation is performed in the separating unit, a separation rate of the separating unit can be improved by using part of the fluid liquefied by the liquefying unit as a reflux.

Preferably, a first separating unit is provided for each of the high-pressure processing chambers and a second separating unit common to the high-pressure processing chambers is provided downstream of these first separating units. With such a construction, minute separations can be efficiently performed since separations corresponding to the processings performed in the high-pressure processing chambers are performed by the respective first separating unit and a common separation is performed by the second separating unit.

Preferably, there is further provided a returning unit for returning the fluid liquefied by the liquefying unit to the second separating unit as a high-pressure fluid containing no unnecessary matter. With such a construction, a separation rate can be improved by returning the fluid liquefied by the liquefying unit to the second separating unit as a high-pressure fluid containing no unnecessary matters.

Preferably, the high-pressure fluid supply unit includes a high-pressure fluid medium storage tank, a pressurizing unit provided downstream of the storage tank, and a heating unit provided downstream of the pressurizing unit, and a recirculating path for returning at least part of the high-pressure fluid pressurized by the pressurizing unit to the high-pressure fluid medium storage tank from an upstream side of the heating unit is formed. With such a construction, the feeding pressure of the pressurizing unit can be set constant even if the amount of the high-pressure fluid to be fed to the high-pressure processing chambers is small and, thus, a stable high-pressure processing can be constantly performed.

Preferably, the high-pressure fluid supply unit includes a high-pressure fluid medium storage tank, a pressurizing unit provided downstream of the storage tank, and a heating unit provided downstream of the pressurizing unit, and a bypass for feeding at least part of the high-pressure fluid obtained through the pressurizing unit and the heating unit to the separating unit is formed. With such a construction, a processing amount at the separating unit can be maintained at a constant level by feeding the heated high-pressure fluid to the separating unit in the case that an amount of the fluid introduced from the high-pressure processing chambers to the separating unit to be separated is small. Therefore, the processing at the separating unit or the liquefying unit can be stably performed.

Preferably, the high-pressure fluid supply unit includes a high-pressure fluid medium storage tank, a pressurizing unit provided downstream of the storage tank, and a heating unit provided downstream of the pressurizing unit, and a bypass for feeding at least part of the high-pressure fluid obtained through the pressurizing unit and the heating unit to at least one of the first separating unit and the second separating unit is formed. With such a construction, processing amounts at the first and second separating unit can be maintained at constant levels by feeding the heated high-pressure fluid to the first and/or second separating unit in the case that an amount of the fluid introduced from the high-pressure processing chambers to the first or second separating unit to be separated is small. Therefore, the processing at the first and second separating unit or the liquefying unit can be stably performed.

As a high-pressure fluid used in the high-pressure processing apparatus of the present invention, carbon dioxide is preferably used in its safety, economical price and readiness to be brought into a supercritical state. Other than carbon dioxide, water, ammonia, nitrous oxide, ethanol, etc. can be used. The high-pressure fluid is used because it has a high diffusion coefficient and, therefore, can diffuse the dissolved contaminants into the high-pressure fluid. In the case that pressure is more increased to make the high-pressure fluid into a supercritical fluid, the fluid comes to possess an intermediate property between gaseous state and liquid state and can better penetrate into fine pattern portions. Further, the high-pressure fluid has a density closer to that of a liquid and can contain considerably more additives (chemical liquids) than a gas.

The high-pressure fluid in the present invention is a fluid having a pressure of 1 MPa or higher. The high-pressure fluid preferably used is a fluid recognized to have a high density, a high solubility, a low viscosity, and a high diffusivility, and more preferably a supercritical or subcritical fluid. In order to make carbon dioxide into a supercritical fluid, temperature and pressure may be set at 31° C. or higher and at 7.1 MPa or higher, respectively. It is preferable to use a subcritical (high-pressure fluid) or supercritical fluid having a pressure of 5 to 30 MPa in a cleaning step, rinsing step after the cleaning step, drying step, and developing step; more preferable to perform these operations at 7.1 to 20 MPa. Hereinafter, although the cleaning operation is described as a representative example of the removal processing performed in the high-pressure processing apparatus of the present invention, the high-pressure processing is not limited to the cleaning operation as described above.

In the high-pressure processing apparatus of the present invention, the cleaning operation is performed by adding a chemical liquid to the high-pressure fluid of, e.g. carbon dioxide to also remove polymer contaminants such as a resist adhered to a semiconductor wafer and an etching polymer in view of the fact that a cleaning power is insufficient if only the high-pressure fluid is used. As a chemical liquid, a basic compound is preferably used as a cleaning component. This is because the basic compound has an action of hydrolyzing a polymer substance often used as the resist and, therefore, has a high cleaning effect. Specific examples of the basic compound include one or more kinds of compounds selected from a group comprising a quaternary ammonium hydroxide, a quaternary ammonium fluoride, alkyl amine, alkanol amine, hydroxyl amine ($NH_2OH$) and ammonium fluoride ($NH_2$ F). It is preferable to contain 0.05 to 8 mass % of the cleaning component to the high-pressure fluid. In the case that the high-pressure processing apparatus of the present invention is used for drying and development, xylene, methyl isobutylketone, quaternary ammonium compound or fluorine-contained polymer may be used as the chemical liquid.

In the case that the cleaning component such as the basic compound dose not dissolve in the high-pressure fluid, it is preferable to use a compatibilizer which can become an adjuvant for dissolving or uniformly diffusing the cleaning component into carbon dioxide as a second chemical liquid. This compatibilizer also acts to prevent contaminants from adhering again in the rinsing step after the cleaning step.

The compatibilizer is not particularly restricted provided that it can make the cleaning component compatible with the high-pressure fluid. Alcohols including methanol, ethanol, isopropanol and alkyl surfoxides such as dimethyl surfoxide are preferably used. An amount of the compatibilizer may be suitably set within a range of 10 to 50 mass % of the high-pressure fluid in the cleaning step.

Hereinafter, the high-pressure processing apparatus of the present invention is described with reference to the accompanying drawings. FIG. 1 shows one embodiment of the high-pressure processing apparatus of the present invention. Identified by 1 is a high-pressure fluid supply unit, which is, in the shown example, provided with a subcooler 11 and a heater 13 in addition to a high-pressure fluid medium storage tank 10 and a pressure pump 12 as essential elements. In the case that liquefied or supercritical carbon dioxide is used as the high-pressure fluid, liquefied carbon dioxide is usually stored in the storage tank 10. If a piping pressure loss including an acceleration resistance is large, the fluid may be cooled beforehand by the subcooler 11 to prevent the fluid from becoming gaseous in the pressure pump 12, high-pressure liquefied carbon dioxide can be obtained by pressurizing the fluid in the pressure pump 12.

A reduction in the amount of carbon dioxide in the system, for example, when high-pressure chambers 30 and 31 are opened to an atmospheric pressure needs to be replenished. Carbon dioxide may be directly supplied to the storage tank 10 if being supplied in a liquid state from a high-pressure bomb containing liquefied carbon dioxide, whereas it may be supplied via a condenser 5 if being supplied in a gaseous state.

The heater 13 is adapted to heat the carbon dioxide to reach a cleaning temperature. Alternatively, the carbon dioxide may be heated to the cleaning temperature or lower or may be heated to a temperature suitable for the processing in each high-pressure chamber by a heating unit provided in each high-pressure chamber to be described later without being preheated by the heater 13.

In this apparatus, the high-pressure fluid supply unit 1 including the storage tank 10 and the pressure pump 12 as essential element is commonly used for the respective chambers 30, 31. This enables the operation rate of the pressure pump 12 to increase and the installation area of the entire apparatus to be smaller. Identified by 14 and 15 are high-pressure fluid supply control unit, specifically high-pressure valves, for adjusting mounts of the high-pressure fluid supplied to the respective chambers, the supplying timings of the high-pressure fluid, etc.

The example of the apparatus shown in FIG. 1 has two chambers: the first high-pressure processing chamber 30 (hereinafter, "first chamber") and the second high-pressure processing chamber 31 (hereinafter, "second chamber"). The number of the chambers is not restricted provided that it is more than two. The chambers are not restricted provided that they are containers having an openable lid and capable of maintaining a high pressure.

Identified by 2A and 2B are a first chemical liquid (cleaning component) supply unit and a second chemical liquid (compatibilizer) supplying unit. In the case that two or more kinds of chemical liquids are used such as when the cleaning component and the compatibilizer are used, a plurality of chemical liquid supply units may be provided as in the shown example. The apparatus can be made more compact by making the first and second chemical liquid supply units common to the respective chambers. Further, an area taken up by the inventive apparatus in the clean room may be made even smaller by providing the respective chemical liquid supplying unit outside the clean room.

The first chemical liquid supply unit 2A is comprised of a first chemical liquid storage tank 20 and a pressure-feed pump 21, and the second chemical liquid supply unit 2B is likewise comprised of a second chemical liquid storage tank 22 and a pressure-feed pump 23. The chemical liquid supply units 2A, 2B are constructed such that the cleaning component and the compatibilizer are supplied to the first and second chambers 30, 31 after having the pressures thereof adjusted to specified values in the respective pressure-feed pumps 21, 23. In the case that fluid compositions necessary for the processings in the respective chambers differ, flow rates of the high-pressure fluid, the first chemical liquid and the second chemical liquid need to be differed for the respective chambers. Thus, first chemical liquid supply control units 24, 25 and second chemical liquid supply control units 26, 27 are provided between the first and second chemical liquid supply units 2A, 2B and the first and second chambers 30, 31. The respective chemical liquid supply control units 24 to 27 may take any construction provided that they have an opening/closing mechanism. Specifically, high-pressure valves may be used as such. The composition of the fluid used for the processing in the chamber can be made into a mixture of the high-pressure fluid, the first and second chemical liquids, a mixture of the high-pressure fluid and the second chemical liquid or only the high-pressure fluid by opening and closing the respective chemical liquid supply control units 24 to 27 and the high-pressure fluid supply control units 15 and 16.

The respective chemical liquid supply control units 24 to 27 are preferably provided near the entrances of the first and second chambers 30, 31, if possible. In the shown example, the chemical liquid supply control units 24 and 25 (26 and 27) are coupled to the first (second) chamber 30 (31) only via a mixing unit 28 (29) and a heating unit 32 (33). Such a construction can prevent the high-pressure fluid from entering the chemical liquid supply units. If three or more kinds of chemical liquids are used, three or more chemical liquid supply units may be provided.

In the example shown in FIG. 1, the mixing units 28 and 29 are provided between the respective chambers 30, 31 and the chemical liquid supply control units. The mixing units 28, 29 act to physically mix the high-pressure fluid and the chemical liquids. A unit for controlling flowing directions of the high-pressure fluid and the chemical liquid by means of a duct mixer to join them may be conveniently used as the mixing unit. Specifically, a so-called static mixer may be used.

Figure 2A:
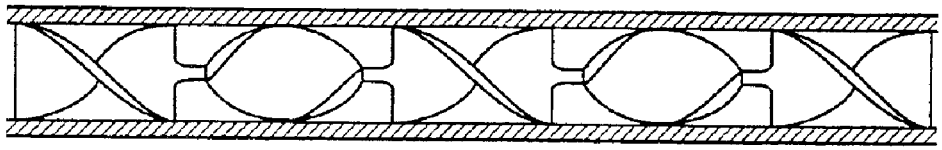
FIG. 2A is a section of a static mixer and FIG. 2B is a perspective view of a mixing element.
Figure 2B:
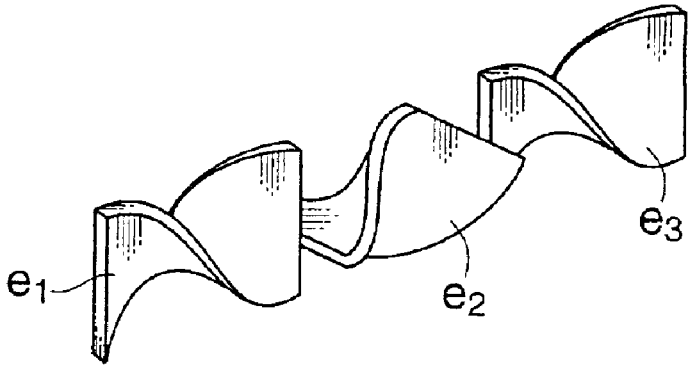

The static mixer is, as shown in FIGS. 2A and 2B, constructed such that a plurality of baffles (mixing elements) e1, e2, e3 . . . (see FIG. 2B) formed by twisting rectangular plates by 180° are arranged in a duct with twisted surfaces thereof angularly displaced by 90° (see FIG. 2A). The flows of the high-pressure fluid and the chemical liquid are divided, reversed and displaced by using this static mixer, controlling the flowing directions, whereby the high-pressure fluid and the chemical liquid flow from upstream side toward downward side while being displaced to up, down, left and right in the duct to be mixed. Of course, the shape, the number and the like of the baffles to be arranged are suitably changed. Although the cleaning liquid and the rinsing liquid can be introduced to the first and second chambers 30, 31 in a satisfactorily mixed state by using the mixing units 28, 29, these units may be omitted.

The heating units 32 and 33 may be provided near the entrances of the first and second chambers 30, 31. This enables high-pressure processing temperatures in the first and second chambers 30, 31 to be differed.

A high-pressure valve 34 and a high-pressure valve 35 are provided downstream of the first and second chambers 30, 31, respectively, and are opened to feed the high-pressure fluid and the like to a separating unit 4 after the respective processings.

The separating unit 4 includes a high-pressure valve 40, a separator 42, and a high-pressure valve 43 for the liquid (or solid) component as elements. Supplementarily, a high-pressure valve 44 (or 46) for gaseous component, a gasifying unit 41, a purifying unit 45 such as an adsorption column may be provided. In the example of the apparatus shown in FIG. 1, the separating unit 4 and the high-pressure fluid supply unit 1 (specifically, storage tank 10) are coupled and a liquefying unit 5 is provided between the separating unit 4 and the storage tank 10 so that the fluid can be used in a recirculated manner. Thus, the gaseous component separated by the separating unit 42 is fed to the liquefying unit 5 via the high-pressure valve 44 and the adsorption column 45 provided if necessary.

The separator 42 separates the fluid into gas and liquid: i.e. into the mixture of the contaminants and the chemical liquid (cleaning component and compatibilizer) as a liquid component as well as transforming the fluid into a gaseous cmponent. The contaminants may deposit as solid matter, be mixed into and separated from the chemical liquid. Various devices capable of gas-liquid separation such as simple distillation, distillation (fractionation) and flash separation and a centrifugal separator can be used as the separator 42. A condenser and the like may be used as the liquefying unit 5. In consideration of an energy cost in the condenser, it is preferable to reduce the pressure not to an atmospheric pressure, but to about 4 to 7 MPa in the separator 42.

The pressure-reduced fluid of carbon dioxide and the like may become a mixture of the gaseous fluid (carbon dioxide gas) and the liquid fluid (liquefied carbon dioxide) depending on the temperature. Accordingly, in order to increase a separation efficiency and a recycle efficiency of the fluid in the separator 42, it is desirable to gasify all the fluid by means of the gasifying unit 41 provided before the separator 42. A heater or the like may be used as the gasifying unit 41. On the other hand, if a centrifugal separator or a film separator is used as the separator 42, the cleaning component, the contaminants and the compatibilizer can be separated without gasifying the high-pressure fluid. It should be noted that the fluid may be released into the air via the high-pressure valve 46 for gaseous component without being used in a recirculated manner.

The liquid (or solid) component including the cleaning component and the compatibilizer containing the contaminants is discharged from the bottom of the separator 42 via the high-pressure valve 43 for liquid (or solid) component and is then processed if necessary.

Although only the separating unit 4 common to the first and second chambers 30, 31 is provided in the shown example, one separating unit 4 may be provided for each chamber. In such a case, the high-pressure valve 40 at the downstream side can be omitted, and separations suited to the processings in the respective chambers can be performed in the respective separating unit. Alternatively, the apparatus may be constructed such that first separating unit each comprised of the high-pressure valves 40, 44 (or 46), 43 and the separator 42 are individually provided for the respective chambers, and a common second separating unit is provided behind. If the separations suited to the respective chambers are performed in the first separating unit and a higher separation such as fractionation or purification is then performed in the common second separating unit in the case that different chemical liquids are used in the respective chambers, a common step can be used even when a plurality of chemical liquids are used. As a result, a stable high-pressure processing can be performed in the entire apparatus.

In the case that this apparatus is used as a high-pressure processing apparatus for a semiconductor wafer, it is preferable to install the first chamber 30, the second chamber 31 and a loading/unloading unit 6 in a clean room and to install the high-pressure fluid supply unit 1, the chemical liquid supply units 2A, 2B and the separating unit 4 as the other essential features outside the clean room. This is because an installation area taken up by the inventive apparatus in the clean room is smaller. The other supplementary units are also preferably installed outside the clean room.

The cleaning step performed using the apparatus of FIG. 1 is started with loading objects to be processed into the first and second chambers 30, 31 by means of the loading/unloading unit 6. In order to make the apparatus compact, it is preferable to commonly use a single loading/unloading unit 6 for the chambers. However, a plurality of loading/unloading unit 6 may be provided. A handling machine such as an industrial robot or a conveying mechanism may be used as the loading/unloading unit 6.

Next, the fluid stored in the storage tank 10 is cooled by the subcooler 11 if necessary to be brought into a perfect liquid state, has its pressure increased by the pressure pump 12 and is heated by the heater 13 to become a supercritical fluid, which is pressure-fed to the first and second chambers 30, 31. The fluid may not be in a supercritical state, but may be in a subcritical or high-pressure liquid state.

The high-pressure fluid is supplied to the first chamber 30 by setting the high-pressure fluid supply control unit 14 at a supply mode; the first chemical liquid is fed from the first chemical liquid storage tank 20 to the mixing unit 28 by the pressure-feed pump 21 and the second chemical liquid is fed from the second chemical liquid storage tank 22 to the mixing unit 28 by the pressure-feed pump 23 with the first and second chemical liquid supply control units 24, 26 set at a supply mode; and the fluid and the first and second chemical liquids are mixed in the mixing unit 28 and fed to the first chamber 30 until a specified pressure is reached. A time required for the specified pressure to be reached in the first chamber 30 is normally shorter than 30 sec. although it depends on the size of the chamber. When the supply of the high-pressure fluid and the chemical liquids into the first chamber 30 is completed and the cleaning step is started, the respective supply control units 14, 24, 26 are set at supply stop mode, the supply of the high-pressure fluid into the second chamber 31 is started by setting the high-pressure fluid supply control unit 15 at the supply mode, the first chemical liquid is fed from the first chemical liquid storage tank 20 to the mixing unit 29 by the pressure-feed pump 21 and the second chemical liquid is fed from the second chemical liquid storage tank 22 to the mixing unit 29 by the pressure-feed pump 23 with the first and second chemical liquid supply control units 25, 27 set at the supply mode, and the fluid and the first and second chemical liquids are mixed in the mixing unit 29 and fed to the second chamber 31 until a specified pressure is reached. It should be noted that the high-pressure fluid and the first and second chemical liquids may be simultaneously fed to the respective chambers 30, 31. The high-pressure valves 34, 35 at the downstream sides of the respective chambers 30, 31 are closed during the cleaning step. A time of about 120 to 180 sec. is normally sufficient for the cleaning step.

By the cleaning step, the contaminants adhered to the objects to be processed are dissolved into the mixed fluid of the high-pressure fluid, the cleaning component, and the compatibilizer added if necessary in the chambers. Accordingly, it is necessary to discharge the mixed fluid into which these contaminants have been dissolved from each chamber. Since the contaminants are dissolved into the high-pressure fluid by the action of the cleaning component and the compatibilizer, the dissolved contaminants may deposit if only the high-pressure fluid is caused to flow into the first and second chambers 30, 31. Thus, after the cleaning step, a second rinsing step only by the high-pressure fluid is performed after a first rinsing step by the high-pressure fluid and the compatibilizer is performed.

The first rinsing step is performed by setting the high-pressure fluid supply control units 14, 15 at the supply mode, setting the first chemical liquid (cleaning component) supply control units 24, 25 at the supply stop mode, setting the second chemical liquid (compatibilizer) supply control units 26, 27 at the supply mode, opening the high-pressure valves 34, 35 at the downstream sides of the respective chambers 30, 31 to continuously supply the high-pressure fluid and the compatibilizer to the respective chambers 30, 31 by the high-pressure fluid supply unit 1 and the second chemical liquid supply unit 2B. It is preferable to set a supplying speed equal to a discharging speed since the pressures in the chambers are preferably the same as that in the cleaning step, but the two speeds may be different. Alternatively, semi-batch type rinsing may be performed by discontinuously supplying the high-pressure fluid and the compatibilizer and discharging as much as supplied. The high-pressure fluid and the like discharged from the respective chambers 30, 31 are fed to the separating unit 4.

Since the contaminants and the cleaning components in the respective chambers 30, 31 gradually decrease by the flows of the high-pressure fluid and the compatibilizer, the second chemical liquid supply control units 26, 27 may be controlled to gradually reduce the supplied amount of the compatibilizer. In the first rinsing step by the high-pressure fluid and the compatibilizer, the cleaning component and the contaminants are all discharged from the respective chambers 30, 31, which are finally filled up with the high-pressure fluid and the compatibilizer. Subsequently, the second rinsing step using only the high-pressure fluid is performed. It should be noted that a time required for the first rinsing step is normally about 30 sec.

In the second rinsing step using only the high-pressure fluid, the contents of the respective chambers 30, 31 are changed from the mixed fluid of the high-pressure fluid and the compatibilizer to the high-pressure fluid by setting the second chemical liquid (compatibilizer) supply control units 26, 27 at the supply stop mode. In this way, the high-pressure processing is completed. It should be noted that a time required for the second rinsing step is normally about 30 sec or less.

On the other hand, in the separating unit 4, the high-pressure fluid, the cleaning component, the contaminants and the compatibilizer flow into the separator 42 in the respective steps. Thus, the high-pressure fluid is made into a gaseous component in the separator 42 suitably using the gasifying unit 41, and the gaseous component is fed to the liquefying unit 5 via the high-pressure valve 44 for gaseous component and the purifying unit 45 or released into the air by closing the high-pressure valve 44 and opening the high-pressure valve 46. The cleaning component, the contaminants and the compatibilizer are taken out as liquid component (partly may contain solid components) through the high-pressure valve 43 for liquid component.

After the completion of the high-pressure processing, the pressures in the respective chambers 30, 31 are reduced to atmospheric pressure by closing the high-pressure valves 34, 35 and then the lids of the chambers 30, 31 are opened to take the processed objects out by means of the loading/unloading unit 6. Since carbon dioxide evaporates by the pressure reduction to atmospheric pressure, the processed objects such as semiconductor wafers can be taken out in a dry state without forming any spot or stain on the outer surfaces thereof and without destroying fine patterns.

Although the first and second chambers 30, 31 share the common first and second chemical liquid supply units 2A, 2B in the high-pressure processing apparatus shown in FIG. 1 as described above, the cleaning step, the first rinsing step and the second rinsing step can be individually performed in the respective chambers by operating the respective supply control units 15, 16, 24 to 27. Accordingly, the respective steps of the high-pressure processing can be finely changed according to the amounts and kinds of the contaminants adhered to the objects to be processed and can be quite efficiently performed.

Figure 3:
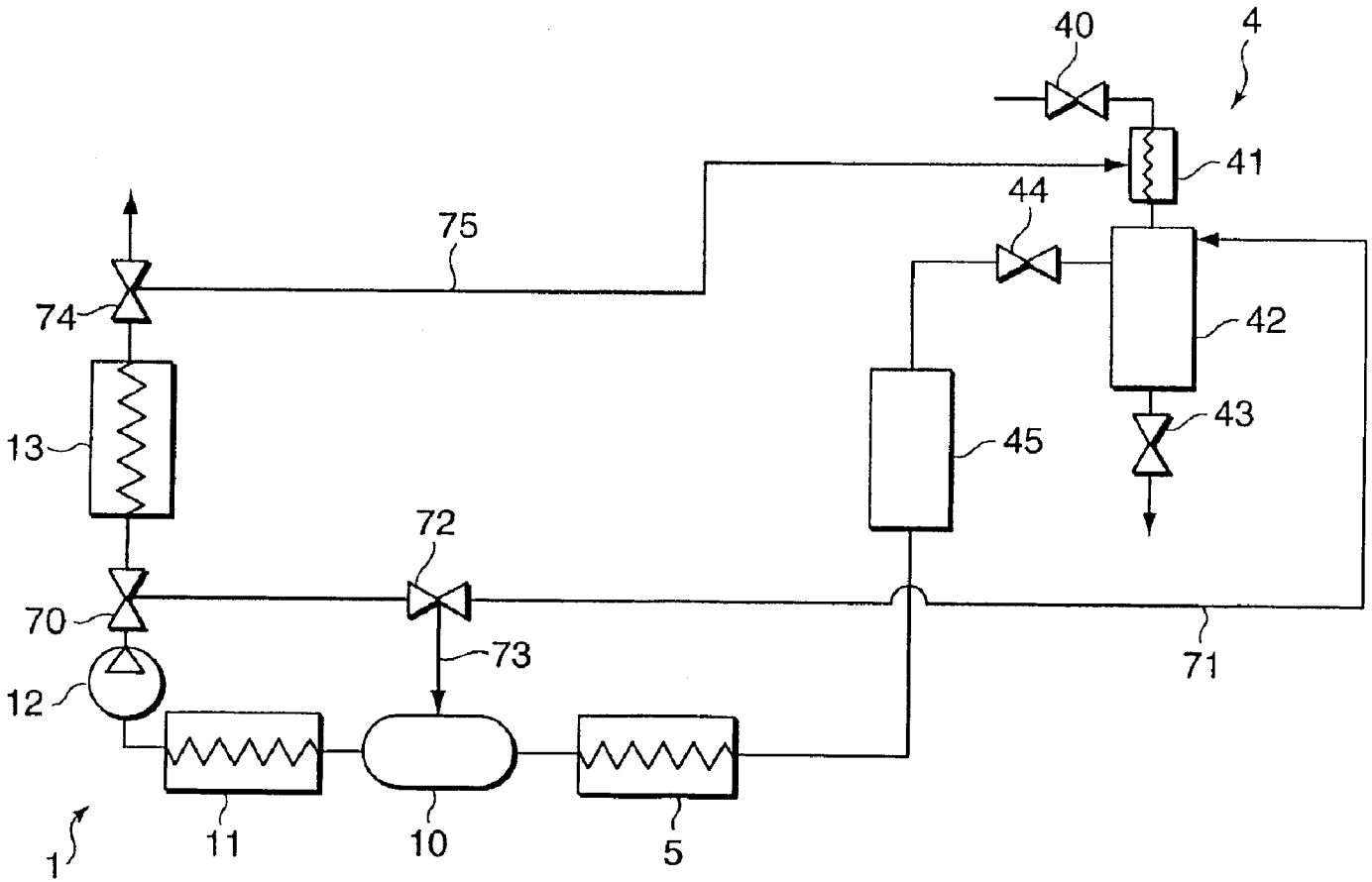
FIG. 3 is a diagram showing another embodiment of the high-pressure processing apparatus according to the invention.

FIG. 3 shows a construction of an apparatus added with a unit for using the high-pressure fluid in a recirculated manner. The apparatus of this shown example is provided with a control valve 70 for returning unit between the pressure pump 12 and the heater 13 and a connecting pipe 71 for returning unit for connecting the control valve 70 and the separator 42 of the separating unit 4. A connecting pipe 73 connecting a control valve 72 for recirculating path and the storage tank 10 is formed in an intermediate position of the connecting pipe 71. Further, a control valve 74 for bypass is provided downstream of the heater 13, and a connecting pipe 75 for bypass is provided to connect the control valve 74 and the gasifying unit 41 of the separating unit 4. Elements omitted in FIG. 3 have the same construction as in FIG. 1.

A returning unit is comprised of the control valve 70 and the connecting pipe 71 and adapted to feed at least part of the high-pressure fluid pressurized by the pressure pump 12 to the top of a distillation column used as the separator 42 to use it as a reflux in the case of distillation in the separator 42. The "high-pressure fluid containing no contaminant" means also to include the fluid distilled in the separator 42 and purified via the purifying unit 45 by the recirculated use of the fluid. If such a high-pressure fluid is returned to the top of the column at the time of distillation, a high boiling-point component is condensed into a liquid component in the separator 42, whereby the gaseous component can be more purified and a separation rate can be improved.

In the case that the separating unit 4 is comprised of the first separating unit for the respective chambers and the common second separating unit and fractionation such as multistage distillation is performed by the second separating unit, the high-pressure fluid can be returned to any desired location of the distillation column of the second separating unit.

The recirculating path is comprised of the control value 70 for returning unit, part of the connecting pipe 71 for returning unit (between the control valve 70 and the control valve 72), the control valve 72 for recirculating path and the connecting pipe 73, and is adapted to return the high-pressure fluid to the storage tank 10. In order to constantly operate the pressure pump 12 at a specific supply pressure for a stable high-pressure processing, part or all of the high-pressure fluid is returned to the storage tank 10 using this recirculating path when the amounts of the high-pressure fluid fed into the chambers 30, 31 are small. Since no heating is necessary, the recirculated fluid may be returned to the storage tank 10 from the upstream side of the heater 13. Although the returning unit and the recirculating path partly share the common connecting path in FIG. 3, they may be, of course, formed by separate connecting pipes.

The bypass is comprised of the control valve 74 and the connecting pipe 75 and adapted to bypass the heated high-pressure fluid to the gasifying unit 41. This is also one measure to constantly operate the pressure pump 12 at a specific supply pressure for a stable high-pressure processing. Since gas may be generated due to an adiabatic expansion if an attempt is made to return the heated high-pressure fluid to the storage tank 10, it is preferable to return it to a position upstream from the liquefying unit 5. Thus, the heated high-pressure fluid is returned to the separating unit 4. The heated high-pressure fluid may be returned to the gasifying unit 41 if the separating unit 4 includes the gasifying unit 41 or may be returned to a position immediately upstream of the high-pressure valve 40. This enables the stable operation of the separating unit 4 and the liquefying unit 5.

Although the example shown in FIG. 3 is provided with all of the returning unit, the recirculating path and the bypass, only one of them may be provided. Further, a system may be constructed such that flow rate meters are provided at suitable positions, e.g. at the upstream sides of the respective chambers to check a flow rate of the fluid into (or out of) the respective chambers and determine the flow rates in the returning unit, the recirculating path and the bypass. Although the high-pressure processing is performed with the high-pressure valves 34, 35 downstream of the respective chambers 30, 31 closed in the foregoing embodiments, these valves may be opened during the processing to allow the high-pressure fluid and the chemical liquids to constantly flow in and out.

The high-pressure processing apparatus of the present invention is effectively used, for example, to clean and develop semiconductor wafers during the semiconductor production process. It is preferable to install at least the high-pressure processing chambers in the clean room, and the other unit may be suitably installed according to the size of the clean room.

According to the present invention, the high-pressure processing apparatus can have a compact construction since a plurality of high-pressure processing chambers are provided and the high-pressure fluid supply unit and the chemical liquid supply unit are commonly used for the chambers. Further, if the high-pressure fluid supply control unit and the chemical liquid supply control unit are provided for each of the chambers, various minute chemical liquid supply conditions can be set. Therefore, the inventive apparatus can be suitably used for removing the contaminants adhered to the semiconductor wafers by the high-pressure fluid.

This application is based on patent application No. 2001-117693 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A high-pressure processing apparatus for removing unnecessary matters on objects to be processed by bringing a high-pressure fluid and a chemical liquid other than the high-pressure fluid into contact with the objects to be processed in a pressurized state, comprising:

a plurality of high-pressure processing chambers, a common high-pressure fluid supply unit for supplying the high-pressure fluid to each one of the high-pressure processing chambers, a common chemical liquid supply unit for supplying the chemical liquid to each high-pressure processing chambers, and a separating unit for separating gaseous components from a mixture of the high-pressure fluid and the chemical liquid discharged from the high-pressure processing chambers after the objects are processed, wherein the plurality of high-pressure processing chambers are installed in a clean room, and the high-pressure fluid supply unit, the chemical liquid supply unit and the separating unit are installed outside the clean room.

2. A high-pressure processing apparatus according to claim 1, wherein at least the plurality of high-pressure processing chambers are installed in a clean room, and at least the high-pressure fluid supply unit is installed outside the clean room.

3. A high-pressure processing apparatus according to claim 2, wherein the separating unit and the high-pressure fluid supply unit are connected, a liquefying unit is provided between the separating unit and the high-pressure fluid supply unit, and the liquefying unit is installed outside the clean room.

4. A high-pressure processing apparatus according to claim 2, wherein a heating unit is provided for each of the high-pressure processing chambers and installed in the clean room.

5. A high-pressure processing apparatus according to claim 1 or 2, wherein the separating unit is provided for each of the high-pressure processing chambers.

6. A high-pressure processing apparatus according to claim 1 or 2, wherein a first separating unit is provided for each of the high-pressure processing chambers and a second separating unit common to the high-pressure processing chambers is provided downstream of these first separating units.

7. A high-pressure processing apparatus according to claim 6, further comprising a returning unit for returning the fluid liquefied by a liquefying unit to the second separating unit as a high-pressure fluid containing no unnecessary matter.

8. A high-pressure processing apparatus according to claim 6, wherein the high-pressure fluid supply unit includes a high-pressure fluid medium storage tank, a pressurizing unit provided downstream of the storage tank, and a heating unit provided downstream of the pressurizing unit, and a bypass for feeding at least part of the high-pressure fluid obtained through the pressurizing unit and the heating unit to at least one of the first separating unit and the second separating unit is formed.

9. A high-pressure processing apparatus according to claim 2, wherein:

chemical liquid supply control units for controlling a supplied amount of the chemical liquid are provided for the respective high-pressure processing chambers between the chemical liquid supply unit and the respective high-pressure processing chambers, mixing units for mixing the high-pressure fluid and the chemical liquid are provided between the respective chemical liquid supply control units and the respective high-pressure processing chambers, and the chemical liquid supply control units and the mixing units are installed in the clean room.

10. A high-pressure processing apparatus according to claim 9, wherein each of the mixing units mix the high-pressure fluid and the chemical liquid by controlling flowing directions of the high-pressure fluid and the chemical liquid to join them.

11. A high-pressure processing apparatus for removing unnecessary matters on objects to be processed by bringing a high-pressure fluid and a chemical liquid other than the high-pressure fluid into contact with the objects to be processed in a pressurized state, comprising:

a plurality of high-pressure processing chambers, a common high-pressure fluid supply unit for supplying the high-pressure fluid to each one of the high-pressure processing chambers, a common chemical liquid supply unit for supplying the chemical liquid to each high-pressure processing chambers, and a separating unit for separating gaseous components from a mixture of the high-pressure fluid and the chemical liquid discharged from the high-pressure processing chambers after the objects are processed, wherein at least the plurality of high-pressure processing chambers are installed in a clean room, and at least the high-pressure fluid supply unit is installed outside the clean room, wherein the separating unit and the high-pressure fluid supply unit are connected, a liquefying unit is provided between the separating unit and the high-pressure fluid supply unit, and the liquefying unit is installed outside the clean room, further comprising a returning unit for returning the fluid liquefied by the liquefying unit to the separating unit as a high-pressure fluid containing no unnecessary matter.

12. A high-pressure processing apparatus for removing unnecessary matters on objects to be processed by bringing a high-pressure fluid and a chemical liquid other than the high-pressure fluid into contact with the objects to be processed in a pressurized state, comprising:

a plurality of high-pressure processing chambers, a common high-pressure fluid supply unit for supplying the high-pressure fluid to each one of the high-pressure processing chambers, a common chemical liquid supply unit for supplying the chemical liquid to each high-pressure processing chambers, and a separating unit for separating gaseous components from a mixture of the high-pressure fluid and the chemical liquid discharged from the high-pressure processing chambers after the objects are processed, wherein the high-pressure fluid supply unit includes a high-pressure fluid medium storage tank, a pressurizing unit provided downstream of the storage tank, and a heating unit provided downstream of the pressurizing unit, and a recirculating path for returning at least part of the high-pressure fluid pressurized by the pressurizing unit to the high-pressure fluid medium storage tank from an upstream side of the heating unit is formed.

13. A high-pressure processing apparatus for removing unnecessary matters on objects to be processed by bringing a high-pressure fluid and a chemical liquid other than the high-pressure fluid into contact with the objects to be processed in a pressurized state, comprising:

a plurality of high-pressure processing chambers, a common high-pressure fluid supply unit for supplying the high-pressure fluid to each one of the high-pressure processing chambers, a common chemical liquid supply unit for supplying the chemical liquid to each high-pressure processing chambers, and a separating unit for separating gaseous components from a mixture of the high-pressure fluid and the chemical liquid discharged from the high-pressure processing chambers after the objects are processed, wherein the high-pressure fluid supply unit includes a high-pressure fluid medium storage tank, a pressurizing unit provided downstream of the storage tank, and a heating unit provided downstream of the pressurizing unit, and a bypass for feeding at least part of the high-pressure fluid obtained through the pressurizing unit and the heating unit to the separating unit is formed.

14. A high-pressure processing apparatus for removing unnecessary matters on objects to be processed by bringing a high-pressure fluid and a chemical liquid other than the high-pressure fluid into contact with the objects to be processed in a pressurized state, comprising:

a plurality of high-pressure processing chambers, a common high-pressure fluid supply unit for supplying the high-pressure fluid to each one of the high-pressure processing chambers, a common chemical liquid supply unit for supplying the chemical liquid to each high-pressure processing chambers, a separating unit for separating gaseous components from a mixture of the high-pressure fluid and the chemical liquid discharged from the high-pressure processing chambers after the objects are processed, wherein at least the plurality of high-pressure processing chambers are installed in a clean room, and at least the high-pressure fluid supply unit is installed outside the clean room, chemical liquid supply control units for controlling a supplied amount of the chemical liquid are provided for the respective high-pressure processing chambers between the chemical liquid supply unit and the respective high-pressure processing chambers, and mixing units for mixing the high-pressure fluid and the chemical liquid are provided between the respective chemical liquid supply control units and the respective high-pressure processing chambers, wherein the chemical liquid supply control units and the mixing units are installed in the clean room.

* * * * *